United States Patent [19]

Schmid et al.

[11] 4,370,203

[45] Jan. 25, 1983

[54] COOLING DEVICE FOR COKE DRY COOLING

[75] Inventors: Karl Schmid; Wilhelm Jakobi, both of Essen, Fed. Rep. of Germany

[73] Assignee: Krupp-Koppers GmbH, Essen, Fed. Rep. of Germany

[21] Appl. No.: 230,595

[22] Filed: Feb. 2, 1981

[30] Foreign Application Priority Data

Mar. 14, 1980 [DE] Fed. Rep. of Germany ..... 3009818

[51] Int. Cl.[3] ..... C10B 39/02

[52] U.S. Cl. ..... 202/228; 34/168

[58] Field of Search ..... 202/228, 227; 34/33, 34/168

[56] References Cited

U.S. PATENT DOCUMENTS 3,895,448 7/1975 Jonnet ..... 202/228

4,141,795 2/1979 Koizumi et al. ..... 202/228

*Primary Examiner*—Norman Yudkoff

*Attorney, Agent, or Firm*—Michael J. Striker

[57] ABSTRACT

A cooling device for dry cooling of coke by a counterflow of gaseous cooling medium has a prechamber, a housing including upper and lower parts, a conduit for discharging a gaseous cooling medium, wherein the prechamber form with the housing an annular space of an increased cross-section in the region of the discharge conduit, the prechamber is connected with the housing by a plurality of mounting members distributed over the periphery of the prechamber, and two sliding joints are provided of which one sliding joint slidingly connects the upper wall with the lower wall, and the other sliding joint slidingly connects the prechamber with the upper wall.

11 Claims, 3 Drawing Figures

COOLING DEVICE FOR COKE DRY COOLING

BACKGROUND OF THE INVENTION

The present invention relates to a cooling device for coke dry cooling. More particularly, it relates to a cooling device in which coke is supplied from above and a gaseous cooling medium is supplied from below in counterflow.

Cooling devices of the above-mentioned general type are known in the art. A known cooling device has a housing with upper and lower parts and a pre-chamber which extends downwardly into the region of a discharge conduit for the gaseous cooling medium. In the known cooling devices which have been utilized for a long time, the drawing off of the gaseous cooling medium from the upper part of the cooling device is performed via an annular passage which remains in masonry of the cooling device coating. This construction has a disadvantage in the fact that a plurality of complicated brick shapes are required for lining of the annular passage in the cooling device coating, and generally for this construction extremely high amount of refractory lining material is necessary. Moreover, the different thermal expansion between the inner and the outer surfaces of the cooling device during the cooling process leads to very fast damages to the refractory lining. In the known constructions, these damages cannot be repaired or can be repaired only with great difficulties and considerable expenses in time and material.

It has also been proposed to arrange in the cooling device an annular insert which forms a so-called prechamber and extends from above into the interior of the cooling device until it overlaps the region below the discharge conduit for the gaseous cooling medium. Such a construction is shown, for example, in FIG. 1 of the German Offenlegungsschrift No. 2,700,783. The coke which is supplied into the cooling device from above exits from the annular insert and accumulates as a pile which forms a closed annular hollow between the inner wall of the cooling device and the outer wall of the annular insert. Since an opening of the discharge conduit for the gaseous cooling medium is also located in this region, hot gases exiting from the coke to be cooled travel through the annular hollow into the discharge conduit. This construction provides for a certain simplification and improvement as compared with the first described construction. However, it is also not free of some disadvantages.

SUMMARY OF THE INVENTION

Accordingly, it is an object of the pesent invention to provide a cooling device which avoids the disadvantages of the prior art.

More particularly, it is an object of the present invention to provide a cooling device which has a lighter and more reliable construction with a lower consumption of a refractory material, as compared with the known cooling devices.

Another object of the present invention is to provide a cooling device which requires less repairs because of the thermal expansion, particularly during heating and cooling processes.

Still another feature of the present invention is to provide a cooling device in which a gas stream exiting from the coke to be cooled is sufficiently distributed and thereby favorable conditions take place in the cooling device.

In keeping with these objects and with others which will become apparent hereinafter, one feature of the present invention resides, briefly stated, in a cooling device in which a pre-chamber forming wall forms together with a housing an annular hollow of an increased cross-section in the region of a discharge conduit, the prechamber forming wall is connected with the housing by a plurality of connecting members which are spaced from one another in a circumferential direction, and upper and lower parts of the housing are connected with one another by a first sliding joint whereas the prechamber forming wall is connected with the upper part of the housing by a second sliding joint.

In accordance with another feature of the present invention, the prechamber forming wall in the region of the discharge conduit has a portion of a reduced cross-section so as to form the above-mentioned annular hollow of the increased cross-section.

The connecting members which connect the prechamber forming wall with the housing may extend over the entire lower portion of the prechamber forming wall and connect the same with the lower wall of the housing. In contrast, the connecting members may extend only over a lower section of the lower portion of the prechamber forming wall.

The prechamber forming wall and the upper and lower walls of the housing can be arranged concentric to one another. In contrast, it is also possible that the upper wall of the cooling device is arranged eccentrical relative to the prechamber forming wall and the lower wall. More particularly, the upper wall is offset in direction toward the discharge conduit from the prechamber forming wall and lower wall.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
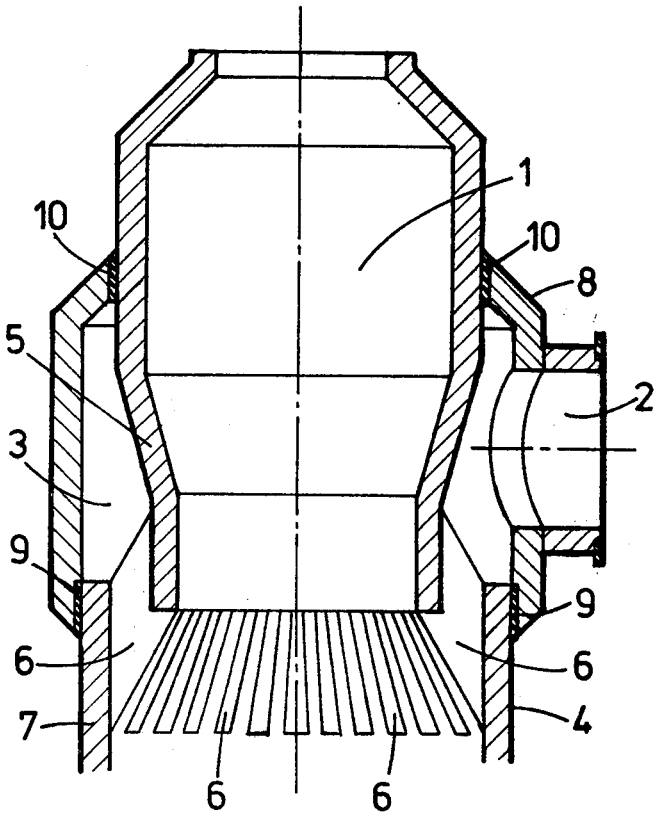
FIG. 1 is a view showing a longitudinal section of a cooling device for coke dry cooling, in accordance with one embodiment of the invention.

A cooling device for dry cooling of coke is shown in the drawing. It is to be understood that only those parts of the cooling device are shown in the drawing which are important for the present invention. The drawings do not show an arrangement for feeding coke to be cooled located at the upper end of the cooling device, an arrangement for discharging cooled coke located at the lower end of the cooling device, and a gas inlet conduit. The cooling in accordance with the present invention operates so that coke to be cooled is supplied from above and a gaseous cooling medium is supplied from below in counterflow.

The cooling device shown in FIG. 1 is a housing composed of an upper part 8 and a lower part 4. A prechamber 1 has arranged substantially upstream relative to the housing as considered in direction of coke supply. In the embodiment shown in FIG. 1, the prechamber 1 and the upper part 8 of the housing are arranged concentric to one another and together form an annular space 3. A gas discharge conduit 2 extends from the upper part 8 of the housing. The annular space 3 has a section located in the region of the gas discharge conduit 2 and having an increased cross-section as compared with a remaining section of the annular space 3. The increased section is formed by reduction of the cross-section of the wall forming the prechamber 1 in the region of the above-mentioned gas discharge conduit 2.

The increase of the cross-section of the annular space 3 in the region of the gas discharge conduit 2 is very important because hot gaseous medium rises from the lower part 4 of the housing into this region before it is discharged through the discharge conduit 2 to a not-shown aspirating arrangement. A wall 5 of the prechamber 1 is constituted of refractory material. The wall 5 is mounted on the housing by a plurality of members identified by reference numeral 6. The members 6 are arranged in a lower part of the wall 5 and on an outer surface of the latter and also constituted of refractory material. The members 6 are distributed over a periphery of the lower part of the wall 5 and advantageously spaced from one another by equal distances. The members 6 have two functions. On the one hand, they mount the prechamber 1 or more particularly the prechamber forming wall 5 on a wall 7 which forms the lower part 4 of the cooling device. Thus they support the prechamber 1 in its desired position. On the other hand, the members 6 define a plurality of uniform passages therebetween and provide for uniformity of the flow of hot gas which rises from the lower part 4 of the cooling device, so that the hot gas is better distributed over the entire cross-section of the annular space 3.

As can be seen from FIG. 1, the wall 5 which forms the prechamber 1 has an upper cylindrical section, a lower cylindrical section, and an intermediate conical section which has a cross-section decreasing from the upper section to the lower section. The mounting members 6 are arranged on the outer surface of the lower cylindrical section of the wall 5 forming the prechamber 1 and connect the above-mentioned lower section with the wall 7 forming the lower part 4 of the housing of the cooling device.

Another important feature of the present invention resides in means for connecting the wall 5 which forms the prechamber 1, the wall which forms the upper part 8 of the housing, and the wall 7 which forms the lower part 4 of the housing. The walls forming the upper part 8 and the lower part 4 of the cooling device are connected with one another by a sliding joint identified by reference numeral 9. The walls forming the prechamber 1 and the upper part 8 of the cooling device are connected by a sliding joint identified by reference numeral 10. As can be seen from the drawing, the cooling device does not have in this case a uniform outer diameter over its entire height. The outer diameter of the wall 7 forming the lower part 4 corresponds to the inner diameter of the wall forming the upper part 8. Thereby, during heating of the cooling device in operation, the lower part 4 freely moves with the aid of the sliding joint 9 on the upper part 8.

Since the sliding joint 10 is provided between the prechamber 1 and the upper part 8, the upper part 8 must not change its position to the extent corresponding to that of the lower part 4. Analogous conditions take place also during cooling of the cooling device, when the lower part 4 and thereby the prechamber 1 are subjected to contraction. The construction of the sliding joints is known in the art for example in air heating arrangements.

Figure 2:
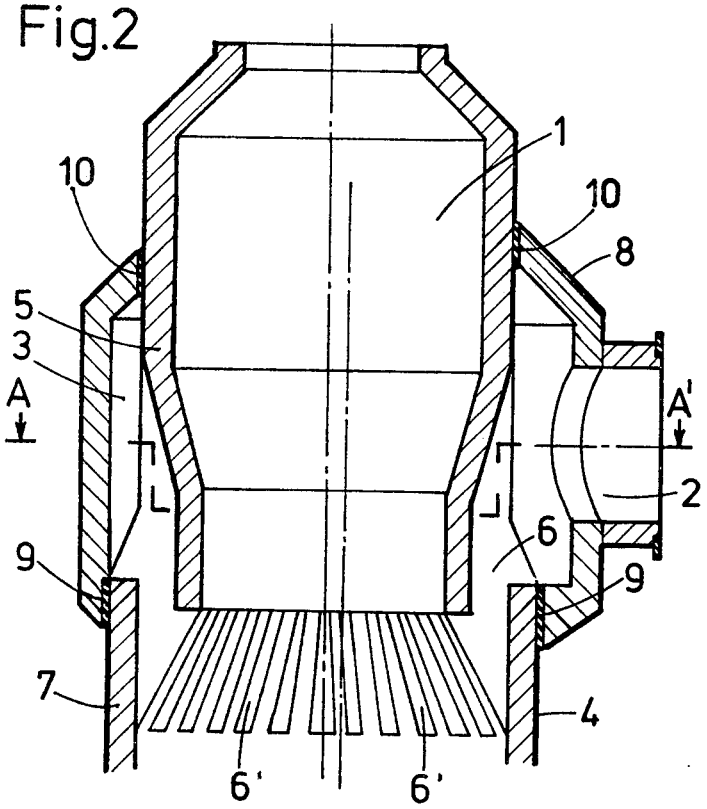
FIG. 2 is a view substantially corresponding to that of FIG. 1 but showing the cooling device for coke dry cooling in accordance with another embodiment of the invention.

FIG. 2 shows a cooling device which somewhat differs from the cooling device of FIG. 1. Parts of the cooling device of FIG. 2 which are identical to the respective parts of FIG. 1 are identified by identical reference numerals. As can be seen from FIG. 2, the upper part 8 of the housing is arranged eccentrically. More particularly, the axis of the upper part 8 is offset relative to the axis of the prechamber 1 and the lower part 4 in direction toward the discharge conduit 2. Because of the eccentric arrangement of the upper part 8, the annular space 3 has a cross-section which is greater in the radial region located close to the discharge conduit 2 then in the radial region located at the diametrically opposite side of the axis. Thereby, the uniform distribution of the gaseous medium which rises through the slots between the members 6 is further improved.

Members 6′ which mount the prechamber 1 on the housing of the cooling device are formed in FIG. 2 differently as compared with the member 6 of FIG. 1. The wall 5 which forms the prechamber 1 also has the upper cylindrical portion, the lower cylindrical portion and the intermediate conical portion extending therebetween. The members 6′ in FIG. 2 are longer than the members 6 of FIG. 1 and extend over the outer surface of the lower cylindrical section and the intermediate conical section of the wall 5 forming the prechamber 1. The thus designed members 6′ provide for improved support of the prechamber 1 as compared with the members 6 of FIG. 1.

Figure 3:
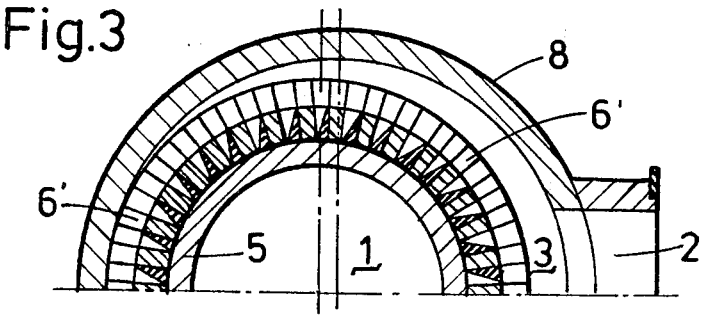
FIG. 3 is a view showing a section taken along the lines A—A' of FIG. 2.

FIG. 3 shows a section taken along the line A—A′ in FIG. 2. More particularly, it shows only one half of the section because the latter are symmetrical. This view clearly shows the eccentricity of the arrangement of the upper part 8 and the circular section of the housing and the prechamber.

The above-described cooling device operates in the following manner. Coke to be cooled is supplied from above into the cooling device and first travels into the prechamber 1. When the coke exits from the prechamber 1, it forms a pile which closes the annular space 3 from below. The rising hot gaseous medium penetrates through the coke and accumulates in the annular chamber 3. The members 6 provide for a uniform distribution of the gaseous medium. The discharge of the gaseous medium from the annular space 3 is performed via the discharge conduit 2 which is connected with a not-shown aspirating arrangement. The hot gaseous medium first travels to a heat recuperating device and thereby again is supplied in cooled state as a cooling medium into the lower part of the cooling device.

The hatched areas in the drawing show the parts constituted of refractory material. It has been shown that the utilization of the inventive construction provides for approximately 30 percent economy of refractory material utilized in the conventional devices. The provision of the sliding joints 9 and 10 considerably reduces the repair susceptibility of the cooling device because of the tension cracks and expansion cracks in the refractory material. When, nevertheless, expected damages of the refractory material take place, the cooling device can be repaired relatively easily and with relatively small expenditures, because the cooling device has a simple construction and is utilized with a relatively small number of brick shapes for the lining.

It will be understood that each of the elements described above, or two or more together, may also find a useful application in other types of constructions differing from the types described above.

While the invention has been illustrated and described as embodied in a cooling device for dry cooling of coke, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cooling device for dry cooling of coke supplied from above by gaseous cooling medium supplied from below in counterflow, the cooling device comprising a wall having an axis and forming a prechamber for supplying coke; a housing located substantially downstream of said prechamber in coke supply direction and having separate upper and lower wall; conduit means for discharging a gaseous cooling medium after passing through the coke and arranged in a predetermined upright region of said housing, said prechamber forming wall extending into said upright region and together with said housing bounding an annular hollow which has an increased cross-section in said region; means for mounting said prechamber forming wall on said housing and including a plurality of mounting members which extend between and connect said prechamber forming wall with said housing, said mounting members being spaced from one another in a circumferential direction so as to form therebetween a plurality of passages for passing the gaseous cooling medium; and means for connecting said walls with one another, said connecting means including a first sliding expansion joint provided between and slidingly connecting said upper wall with said lower wall, and a second sliding expansion joint provided between and slidingly connecting said prechamber forming wall with said upper wall.

2. A cooling device as defined in claim 1, wherein said prechamber forming wall has a lower portion, said mounting members extending between and connecting said lower portion of said prechamber forming wall with said housing.

3. A cooling device as defined in claim 2, wherein said mounting members connect said lower portion of said prechamber forming means with said lower wall of said housing.

4. A cooling device as defined in claim 2, wherein said lower portion of said prechamber forming wall has a lower section having a smaller cross-section than that of said remaining portion of the same, and an intermediate section located between said lower section and said remaining portion and having a cross-section which decreases from the latter to the former, said mounting members extending over and connecting said lower section of said lower portion of said prechamber forming means with said housing.

5. A cooling device as defined in claim 2, wherein said lower portion of said prechamber forming wall has a lower section having a smaller cross-section, than that of the remaining portion of the same, and an intermediate section located between said lower section and said remaining portion and having a cross-section which decreases from the latter to the former, said mounting members extending over and connecting said lower section and said intermediate section of said lower portion of said prechamber forming wall with said housing.

6. A cooling device as defined in claim 1, wherein said mounting members are uniformly spaced from one another in the circumferential direction.

7. A cooling device as defined in claim 1, wherein said upper and lower walls of said housing have axes coinciding with said axis of said prechamber forming wall so that said walls are arranged concentrically to each other.

8. A cooling device as defined in claim 1, wherein said upper and lower walls of said housing have axes, said upper wall being arranged excentrically to said prechamber forming wall and to said lower wall and offset relative to the same in direction toward said discharging conduit means.

9. A cooling device as defined in claim 8, wherein said prechamber forming wall and said lower wall of said housing are arranged concentrically to one another.

10. A cooling device as defined in claim 1, wherein said upper wall of said housing and said lower wall of said housing have different diameters determined upon one another so as to provide for connection of said upper and lower walls with one another.

11. A cooling device as defined in claim 1, wherein said prechamber forming wall has a portion of a reduced cross-section in said upright region in which said conduit means is arranged, so that said annular hollow of an increased cross-section is formed by said portion of a reduced cross-section of said prechamber forming wall without changing the cross-section of said housing.

* * * * *